US005960592A

United States Patent [19]

Lilienthal, II et al.

[11] Patent Number: 5,960,592

[45] Date of Patent: Oct. 5, 1999

[54] PROTECTIVE ENCLOSURE FOR OUTDOOR EQUIPMENT

[75] Inventors: Peter F. Lilienthal, II, Princeton, N.J.; Ivan Pawlenko, Holland, Pa.

[73] Assignee: Lucent Technologies Inc., Murray Hill, N.J.

[21] Appl. No.: 09/075,551

[22] Filed: May 11, 1998

[51] Int. Cl.[6] ..... E04H 9/00

[52] U.S. Cl. ..... 52/79.1; 52/79.7; 52/79.9; 52/745.02; 52/79.5

[58] Field of Search ..... 52/79.1, 79.5, 52/79.7, 79.9, 745.02, 745.03, 309.9, 309.11, 795.1, 783.1, 742.13, 405.2, 406.1, 404.4; 220/4.28, 592.25, 592.26, 902, DIG. 9, 4.09; 264/267

[56] References Cited

U.S. PATENT DOCUMENTS

| | | | |
|---|---|---|---|
| 2,271,355 | 1/1942 | Sweet | 20/4 |
| 2,961,116 | 11/1960 | Jeppson | 220/4.28 |
| 3,137,744 | 6/1964 | Burrus | 220/4.28 |
| 3,256,860 | 6/1966 | Parker | 52/79.1 |
| 3,305,986 | 2/1967 | Mathews | 52/79.1 |
| 3,371,816 | 3/1968 | Ricci | 220/4.28 |
| 3,517,468 | 6/1970 | Woods | 52/79.1 |
| 4,272,935 | 6/1981 | Lukas et al. | 52/309.11 |
| 4,805,357 | 2/1989 | Aleixo | 52/79.1 |
| 5,315,794 | 5/1994 | Pearson | 52/79.1 |
| 5,560,150 | 10/1996 | Pearson | 52/79.14 |
| 5,724,774 | 3/1998 | Rooney | 52/79.5 |
| 5,749,178 | 5/1998 | Garmong | 52/79.1 |
| 5,755,062 | 5/1998 | Slater | 52/79.1 |
| 5,848,500 | 12/1998 | Kirk | 52/79.1 |

*Primary Examiner*—Carl D. Friedman
*Assistant Examiner*—Dennis L. Dorsey

[57] ABSTRACT

A protective enclosure for equipment situated out of doors. The enclosure is formed as hollow panels by a blow molding process and allows the introduction at the installation site of protective material into any desired ones of the internal cavities of the panels, thereby reducing manufacturing and transportation costs.

13 Claims, 3 Drawing Sheets

PROTECTIVE ENCLOSURE FOR OUTDOOR EQUIPMENT

BACKGROUND OF THE INVENTION

This invention relates to equipment which is situated out of doors, such as telephone equipment, and, more particularly, to a protective enclosure for such equipment.

Certain equipment is frequently installed out of doors, for example, telephone equipment and cable TV equipment. Wires are then routed from the outdoor equipment to individual indoor telephones or televisions. Such equipment must be protected from the elements, such as excessive heat or cold, rain, snow, or other naturally occurring conditions. Present day protective enclosures, or cabinets, are relatively expensive to manufacture. Accordingly, it would be desirable to provide a protective enclosure for outdoor equipment which is economical to manufacture.

Often, such equipment is situated in a remote area. Present protective enclosures are expensive to transport due to their weight and bulkiness. It would therefore be further desirable to provide such an enclosure which is less costly to transport.

In addition to being exposed to adverse environmental conditions, it is not uncommon that such enclosures become gunfire targets, especially when in remote locations. It would therefore also be desirable to provide such an enclosure which can protect the enclosed equipment from bullets.

SUMMARY OF THE INVENTION

The present invention provides a protective enclosure for outdoor equipment which is economical to manufacture and transport, and is capable of providing protection from bullets. The inventive enclosure is formed as a double-wall cabinet structure which is lightweight and easy to transport to an installation site. At the site, the equipment is installed in the cabinet and, if desired, the space between the double walls of the cabinet is filled with a protective material, such as a masonry material.

In accordance with an aspect of this invention, the enclosure is formed of plastic by a blow molding process.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
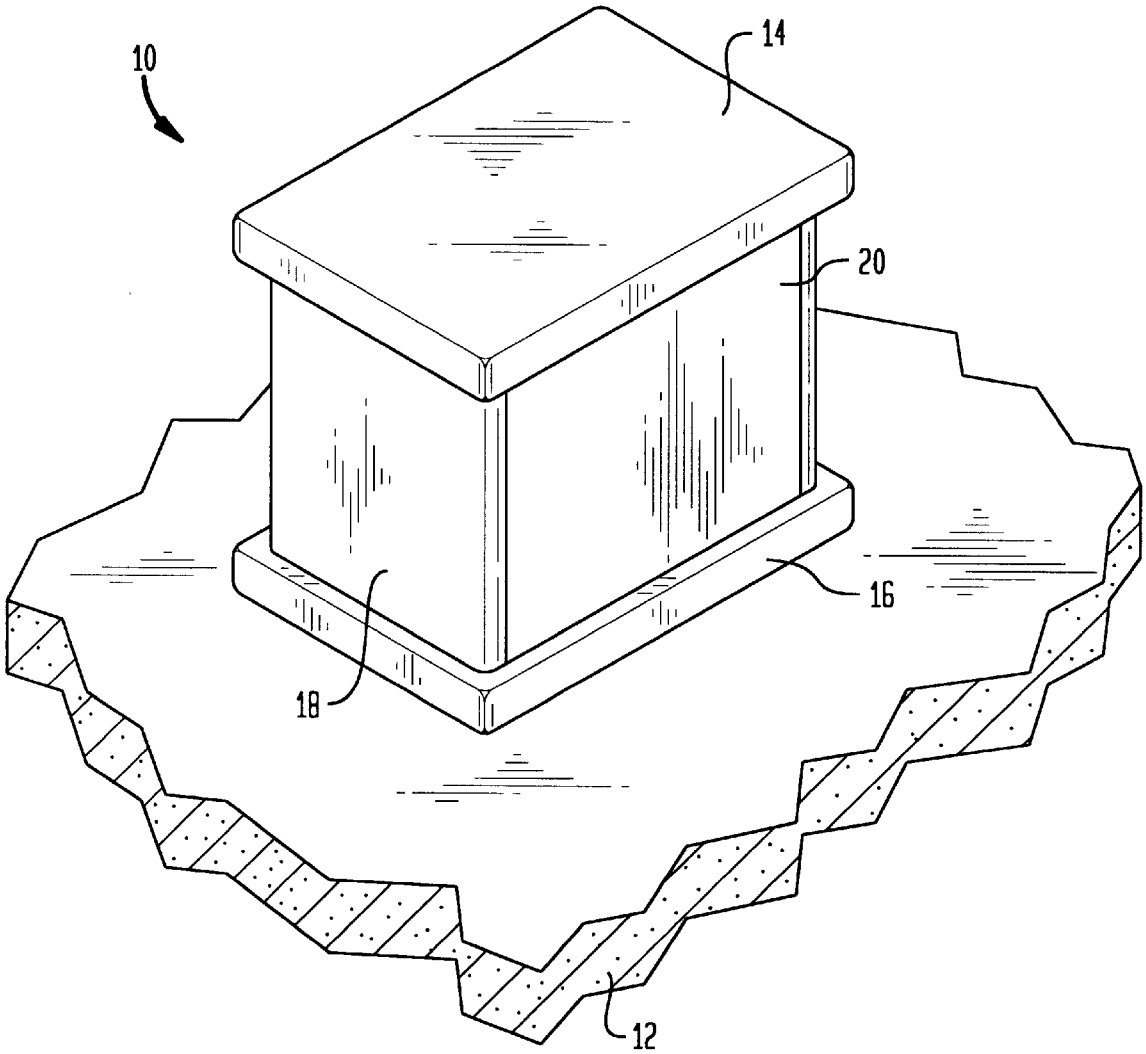
FIG. 1 is a perspective view showing a first embodiment of a protective enclosure according to the present invention installed at a site.

Referring now to the drawings, FIG. 1 illustrates a typical outdoor equipment installation within an enclosure according to a first embodiment of the present invention. As shown, the enclosure, designated generally by the reference numeral 10, is mounted on a platform 12, illustratively a concrete slab. Such mounting would be by way of bolts (not shown) set into the concrete and extending through openings provided therefor in the floor of the enclosure 10. Alternatively, the enclosure 10 may be mounted at an elevated location on a pole or a building, for example.

Figure 2:
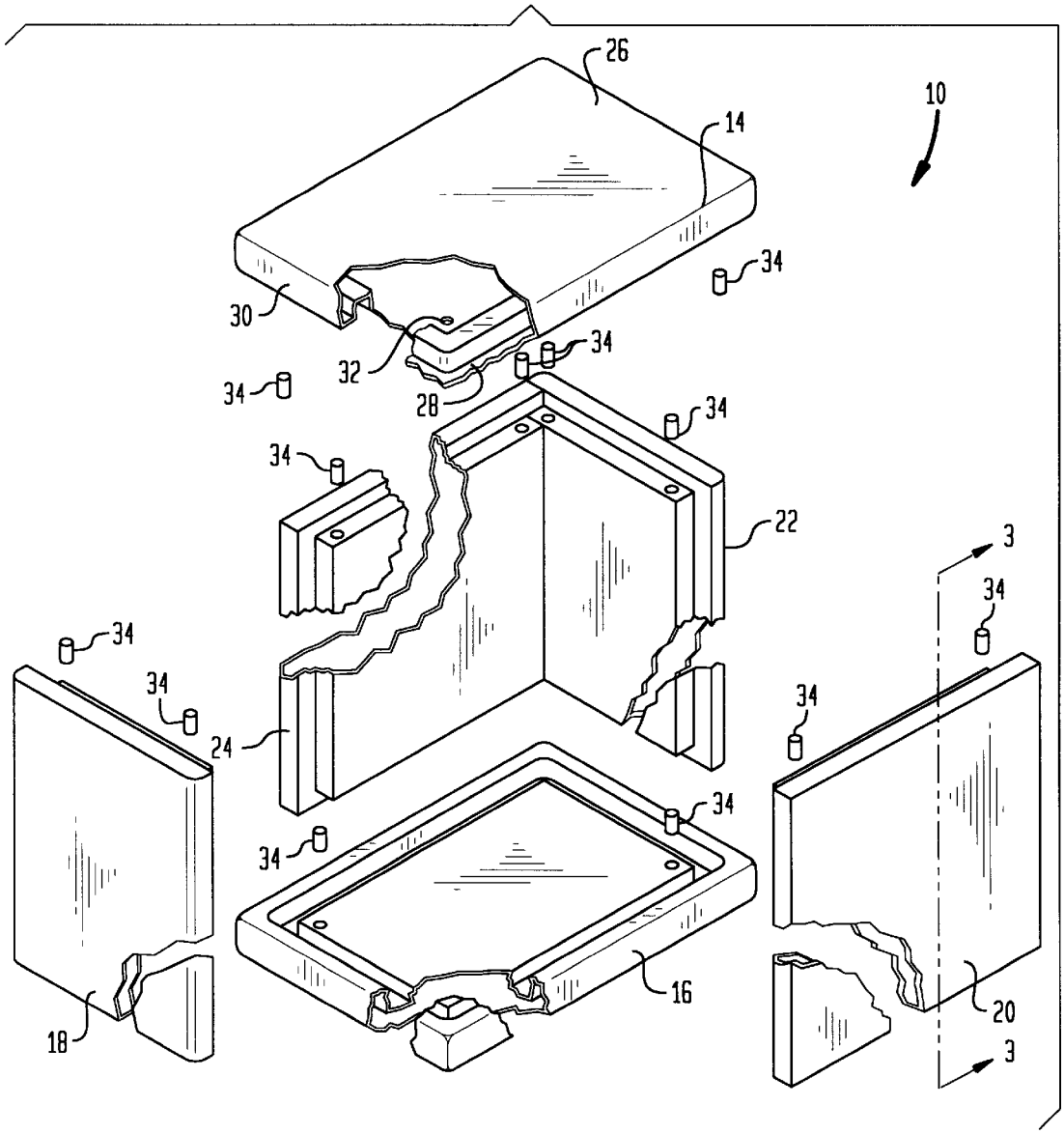
FIG. 2 is an exploded perspective view of the enclosure shown in FIG. 1.

As shown in FIG. 2, the illustrative enclosure 10 is formed of a top panel 14, a bottom panel 16 and side panels 18, 20, 22, 24. The top panel 14 includes an outer top panel wall 26, an inner top panel wall 28 which is spaced from the wall 26 and at least one connecting wall 30 joining the walls 26, 28. The walls 26, 28, 30 together define and surround an internal cavity. The top panel 14 further includes an opening 32, illustratively through the inner wall 28, communicating with the internal cavity. Preferably, the top panel 14 is formed of a plastic material by a blow molding process. The blow molding process reduces the manufacturing cost, and the use of recycled plastic material can result in even greater cost savings.

Although they may be configured differently from the top panel 14 and from each other, the bottom panel 16 and the side panels 18, 20, 22, 24 are similar in that they each include an outer wall, an inner wall spaced from the outer wall, and a connecting wall to surround and define an internal cavity, with at least one opening through one of the walls communicating with the internal cavity. Preferably, a blow molding process is used to form the bottom panel 16 and the side panels 18, 20, 22, 24 from a plastic material.

In addition to the panels, the enclosure 10 also includes a plurality of caps 34 each for sealing a respective one of the openings communicating with an internal cavity of a panel.

In the embodiment shown in FIGS. 1 and 2, the enclosure 10 is designed as a snap-fit assembly with the side panels 18, 20, 22, 24 extending between the top panel 14 and the bottom panel 16 to form an interior space bounded by all of the panels. Alternatively, hardware or adhesive can be utilized for joining the panels. In any event, the flat, hollow panels are lightweight and can be packaged for shipment in a much smaller volume than an assembled cabinet of the prior art. Once brought to the site, the bottom panel 16 can be secured to the platform 12, the equipment can be installed on the bottom panel, and the remaining panels can be assembled to form an enclosure around the equipment.

Figure 3:
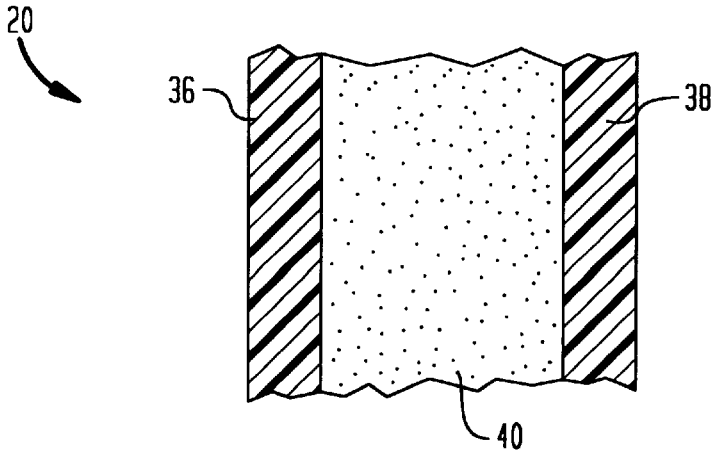
FIG. 3 is a partial cross sectional view taken along the line 3—3 in FIG. 2.

As discussed above, for certain installations, it is desirable to provide reinforced panels to provide additional insulative and/or impact protection. As shown in FIG. 3, the panel 20 has an inner wall 36 and an outer wall 38 and the internal cavity of the panel 20 is filled with protective material 40. The material 40 can be an energy absorbing material, a masonry material, a kevlar material, a carbon fiber material, a ceramic material, an expanded metal material, or the like. In any event, the protective material 40 can be installed in the panels at the installation site of the enclosure 10 by pouring it through the openings of any desired ones of the panels and then sealing the openings with the caps 34. This reduces transportation costs because the panels themselves are relatively lightweight and can be transported in a stacked manner, having a smaller volume than an assembled enclosure. Further, the end user has the option of whether or not to fill any of the panel cavities with a protective material.

Figure 4:
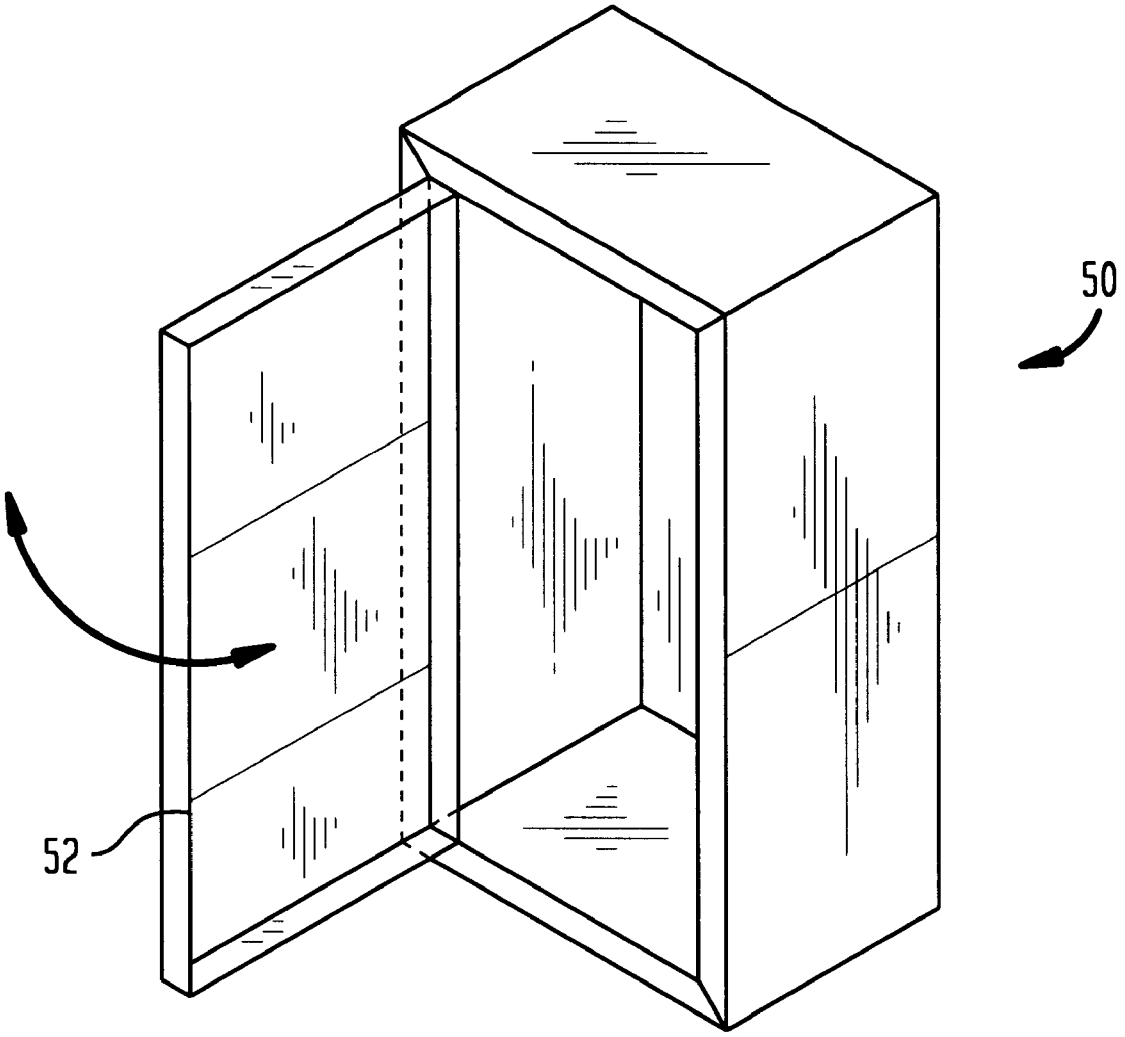
FIG. 4 is a perspective view of an alternate embodiment of a protective enclosure according to this invention.

FIG. 4 shows an alternate embodiment of an enclosure 50 wherein the side panel 52 is formed as a pivoting door, but the basic principles of construction of the enclosure 50 are the same as for the enclosure 10 described above. It is also known that enclosures of the type described can be made as a unitary piece with integral hinges between panels and snap-fit features along the edges of the panels so that the enclosure can be transported as a flat piece and then with proper folding an enclosure can be formed.

It has been estimated that the aforedescribed enclosure construction results in an approximately tenfold savings over manufacturing a reinforced cabinet from sheet metal.

Accordingly, there have been disclosed embodiments of an improved protective enclosure for outdoor equipment. While illustrative embodiments of the present invention have been disclosed herein, it is understood that various modifications and adaptations to the disclosed embodiments will be apparent to those of ordinary skill in the art and it is intended that this invention be limited only by the scope of the appended claims.

What is claimed is:

1. A protective enclosure for outdoor equipment comprising:

a top panel including an outer top panel wall, an inner top panel wall spaced from said outer top panel wall, at least one connecting top panel wall joining said inner and outer top panel walls to define a top panel cavity surrounded by all of said top panel walls, and at least one opening through one of said top panel walls communicating with said top panel cavity;

a bottom panel including an outer bottom panel wall, an inner bottom panel wall spaced from said outer bottom panel wall, at least one connecting bottom panel wall joining said inner and outer bottom panel walls to define a bottom panel cavity surrounded by all of said bottom panel walls, and at least one opening through one of said bottom panel walls communicating with said bottom panel cavity;

at least one side panel including an outer side panel wall, an inner side panel wall spaced from said outer side panel wall, at least one connecting side panel wall joining said inner and outer side panel walls to define a side panel cavity surrounded by all of said side panel walls, and at least one opening through one of said side panel walls communicating with said side panel cavity, said at least one side panel extending between said top and bottom panels to form an interior space bounded by said top and bottom panels and said at least one side panel; and a plurality of caps each for sealing a respective one of said openings.

2. The enclosure according to claim 1 further comprising:

protective material filling any of the cavities of said panels;

wherein said material is selected from the group consisting of energy absorbing material, masonry material, kevlar material, carbon fiber material, ceramic material and expanded metal material.

3. The enclosure according to claim 1 wherein said panels are stackable for transporting.

4. The enclosure according to claim 1 wherein said panels are part of a unitary piece which includes all of the panels, integral hinges between panels and snap-fit features along the edges of the panels.

5. A method for providing at an outdoor site a protective enclosure for equipment, comprising the steps of:

providing a top panel including an outer top panel wall, an inner top panel wall spaced from said outer top panel wall, at least one connecting top panel wall joining said inner and outer top panel walls to define a top panel cavity surrounded by all of said top panel walls;

providing a bottom panel including an outer bottom panel wall, an inner bottom panel wall spaced from said outer bottom panel wall, at least one connecting bottom panel wall joining said inner and outer bottom panel walls to define a bottom panel cavity surrounded by all of said bottom panel walls;

providing at least one side panel including an outer side panel wall, an inner side panel wall spaced from said outer side panel wall, at least one connecting side panel wall joining said inner and outer side panel walls to define a side panel cavity surrounded by all of said side panel walls;

transporting said panels to said site;

assembling said panels into an enclosure with said at least one side panel extending between said top and bottom panels to form an interior space bounded by said top and bottom panels and said at least one side panel;

providing equipment; and installing said equipment in the interior space bounded by said panels.

6. The method according to claim 5 wherein each of the steps of providing a panel includes the step of forming a panel as a unitary plastic piece by a blow molding process.

7. The method according to claim 5 wherein each of the panels is formed with at least one opening through one of its walls communicating with its cavity, further including the step of providing a plurality of caps each for sealing a respective one of said panel openings, and further including after the steps of transporting the steps of:

filling any of said cavities at said site with a protective material selected from the group consisting of energy absorbing material, masonry material, kevlar material, carbon fiber material, ceramic material and expanded metal material; and installing said plurality of caps each in a respective one of said openings.

8. The method according to claim 5 wherein the step of transporting includes the step of stacking the panels.

9. The method according to claim 5 wherein the steps of providing the panels includes the step of providing a unitary piece including all of the panels with integral hinges between panels and snap-fit features along the edges of the panels.

10. The method according to claim 9 wherein each of the panels is formed with at least one opening through one of its walls communicating with its cavity, further including the step of providing a plurality of caps each for sealing a respective one of said panel openings, and further including after the steps of transporting the steps of:

filling any of said cavities at said site with a protective material selected from the group consisting of energy absorbing material, masonry material, kevlar material, carbon fiber material, ceramic material and expanded metal material; and installing said plurality of caps each in a respective one of said openings.

11. The method according to claim 9 wherein the step of transporting includes transporting the unitary piece as a flat piece.

12. A method for protecting equipment, comprising the steps of:

providing a top panel including an outer top panel wall, an inner top panel wall spaced from said outer top panel wall, at least one connecting top panel wall joining said inner and outer top panel walls to define a top panel cavity surrounded by all of said top panel walls;

providing a bottom panel including an outer bottom panel wall, an inner bottom panel wall spaced from said outer bottom panel wall, at least one connecting bottom panel wall joining said inner and outer bottom panel walls to define a bottom panel cavity surrounded by all of said bottom panel walls;

providing at least one side panel including an outer side panel wall, an inner side panel wall spaced from said outer side panel wall, at least one connecting side panel wall joining said inner and outer side panel walls to define a side panel cavity surrounded by all of said side panel walls;

assembling said panels into an enclosure with said at least one side panel extending between said top and bottom panels to form an interior space bounded by said top and bottom panels and said at least one side panel; and installing equipment in the interior space bounded by said panels.

13. The method according to claim 12 wherein each of the panels is formed with at least one opening through one of its walls communicating with its cavity, further including the step of providing a plurality of caps each for sealing a respective one of said panel openings, and further including the steps of:

filling any of said cavities with a protective material selected from the group consisting of energy absorbing material, masonry material, kevlar material, carbon fiber material, ceramic material and expanded metal material; and installing said plurality of caps each in a respective one of said openings.

* * * * *